US008113897B2

(12) United States Patent
Hanson

(10) Patent No.: US 8,113,897 B2
(45) Date of Patent: Feb. 14, 2012

(54) FLOTATION AID

(76) Inventor: John Hanson, Gold Coast (AU)

( * ) Notice: Subject to any disclaimer, the term of this patent is extended or adjusted under 35 U.S.C. 154(b) by 531 days.

(21) Appl. No.: 12/258,445

(22) Filed: Oct. 27, 2008

(65) Prior Publication Data

US 2009/0111342 A1 Apr. 30, 2009

(51) Int. Cl.
*B63C 9/15* (2006.01)

(52) U.S. Cl. ..... 441/96

(58) Field of Classification Search ..... 441/90–101
See application file for complete search history.

(56) References Cited

U.S. PATENT DOCUMENTS

| | | | | |
|---|---|---|---|---|
| 3,173,162 | A * | 3/1965 | Elder, Jr. | 441/94 |
| 3,302,224 | A * | 2/1967 | Boucher | 441/94 |
| 3,975,785 | A | 8/1976 | Stadeker | |
| 4,267,944 | A | 5/1981 | Mackal | |
| 4,551,106 | A | 11/1985 | Prager | |
| 4,810,219 | A * | 3/1989 | Anderson et al. | 441/80 |
| 5,456,623 | A | 10/1995 | Norris | |
| 6,123,227 | A | 9/2000 | Umeda | |

FOREIGN PATENT DOCUMENTS

| | | |
|---|---|---|
| AU | 16157/76 | 1/1978 |
| FR | 2727380 | 5/1996 |
| WO | WO 01/44044 | 6/2001 |
| WO | WO 2005/023639 | 3/2005 |

* cited by examiner

*Primary Examiner* — Edwin Swinehart

(57) ABSTRACT

A flotation aid which has an inflation unit comprising an inflatable bladder and a gas container assembly including a capsule containing a compressed gas for inflating the bladder and having a valve through which gas may be released into the bladder, the gas container assembly being located substantially within the bladder and actuating means actuable externally of the bladder for actuating the valve to allow release of gas from the capsule into the bladder to inflate the bladder. In one form, the inflation unit is housed within a two-part longitudinally split casing, the parts of the casing being interconnected but being separated upon and by inflation of the bladder to release the bladder. In another form, the floatation aid is incorporated in pants or other article of clothing being located in a pocket and secured to the pants or article of clothing.

20 Claims, 7 Drawing Sheets

FLOTATION AID

TECHNICAL FIELD

This invention relates to a flotation aid and in particular to a personal flotation aid which may used to assist a person to float in water.

BACKGROUND ART

There have been in the past a number of occurrences of drownings in surf conditions where swimmers or bathers may be inexperienced in such conditions and/or are swimming or bathing in an area which is not patrolled by lifeguards or lifesavers. Drownings also often occur as a result of boating accidents. There is thus a need for an aid which will assist persons including children in these situations and in particular which will support a person in the water at least temporarily.

A number of different forms of personal flotation aid are currently available. These can be in the configuration of a life jacket or vest which is worn by a user who is partaking in a pastime where water safety is a requirement. Such pastimes include water skiing, and boating including sailing. The currently available life jackets or vests however are generally bulky and restrict movement. Further life jackets or vests are not useful where a person requires a temporary floatation aid when swimming or bathing.

SUMMARY OF THE INVENTION

The present invention aims to provide to provide a personal flotation aid which is relatively compact, which may be relatively easily actuated and which may be simply and effectively worn or carried by a person to assist the person to float in water and therefore reduce the risks of drowning. The flotation aid of the invention is particularly suited for use by a person swimming or engaging in watersports or similar activities but may also be used in other situations. The present invention in another aspect aims to provide an article of clothing typically shorts which incorporate the flotation aid. Other objects and advantages of the invention will become apparent from the following description.

The present invention thus provides in one preferred aspect a flotation aid comprising an inflation unit having:

an inflatable bladder;

a gas container assembly including a gas container containing a compressed gas for inflating said bladder, said gas container including valve means at one end through which a gas may be released into said bladder, said gas container assembly being located at least substantially within said bladder, said gas container assembly further including an actuator adjacent said one end of said container, said actuator being actuable externally of said bladder and moving longitudinally of said container when actuated to cause said valve means to move to an open position, said actuator cooperating with said gas container when actuated to maintain said valve means in said open position to allow release of gas from said gas container into said bladder to inflate said bladder.

Preferably the gas container comprises a gas capsule or canister and the valve means is provided at one end of the gas capsule or canister. Preferably the bladder has a mouth which is sealed directly or indirectly to the gas capsule or canister. Preferably a gas capsule holder or base member is provided at the other end of the gas capsule or canister. Preferably the capsule holder or base member includes a hollow cup-shaped portion in which the capsule or canister seats. Preferably the capsule or canister is frictionally and sealingly engaged with the capsule holder.

Preferably the capsule holder or base member includes a stem and the mouth of the bladder is sealed to the stem. Preferably clamp means are suitably provided for clamping and sealing the mouth of the bladder to the stem. The clamp means may comprise an annular clamp such as a hose-type clamp. The bladder may also be sealed adjacent its mouth to the holder by any suitable adhesive.

Suitably the capsule includes an annular collar adjacent the valve means and the actuator is slidable over the collar when actuated. Preferably the actuator is frictionally engaged with the collar. Preferably the actuator includes an actuating member which when depressed causes the valve means to open. The valve means may comprise a valve member suitably a hollow valve member which extends from the gas capsule and the valve member is adapted to cooperate with the actuating member of the actuator. Preferably depression of the actuating member causes movement of the valve member and opening of the valve means.

The actuator suitably includes a stop member adapted to cooperate with the collar when the actuator is actuated to maintain the actuator in an actuated position. Preferably the stop member is adapted to locate on a lower or underside of the collar to maintain the actuator in an actuated position. The actuator suitably includes a body having a wall which surrounds the collar preferably being frictionally engaged therewith and the stop member is provided on the inside of the wall and is forced from a position on the upper side of the collar to a position on the lower side of the collar when the actuator is actuated. The body suitably comprises a hollow cup-shaped body and the wall of the body comprises a cylindrical or annular side wall which surrounds and is frictionally engaged with the collar. The stop member suitably comprises an annular or part annular rib which in the unactuated position is located on the upper side of the capsule collar. Preferably when the actuator is actuated by depression of the actuating member, the annular or part annular rib is forced downwardly past the collar to locate on the lower or underside of the capsule collar to maintain the actuator in an actuated position.

The actuating member may project from the hollow cup-shaped body. The actuating member preferably is hollow to receive the valve member. The actuating member suitably extends longitudinally of the capsule and is arranged coaxially with the cylindrical or annular wall of the hollow cup-shaped body. Preferably the cup-shaped body and/or actuating member is provided with one or more apertures to allow release of gas passing through the open valve means into the bladder. Preferably the cup-shaped body includes an end wall from which the cylindrical or annular wall extends and the end wall may include the one or more apertures.

Suitably the gas from the capsule issues as a liquid and upon expansion cools to cause the actuator body to contract and frictionally lock onto the collar to assist in maintaining the actuator in the actuated position and the valve open.

In one embodiment, the inflation unit is located within an external casing and is adapted to be actuated externally of the casing. Preferably the casing is a two part longitudinally split casing. Preferably the two parts of the casing are normally interconnected but may be at least partially separated upon and by inflation of the bladder. Any form of interconnection means may be provided between the casing parts for this purpose such as a "snap" interconnection means or complementary ribs and grooves in the respective parts.

One of the parts of the casing may allow for external actuation of the actuating means. Preferably the one part of the casing includes a flexible portion which allows for actuation of the actuator. Preferably the one part of the casing is formed of a flexible material such as a rubber or a similar synthetic material and comprises a push button. Preferably the one part of the casing is formed of a flexible material such as rubber and the push button is provided at one end of the casing and is suitably integrally formed with the one part of the casing. Preferably the push button is aligned with the actuating member. Preferably the other part of the casing is formed of a rigid material such as metal or stiff plastics. Preferably the casing parts are formed in a moulding process.

The inflatable bladder may be formed of any suitable thin flexible or pliable material substantially impervious to the propellant or gas. Typically, the bladder may be formed of plastics material, such as a thin vinyl material, a latex rubber, or neoprene. Preferably the bladder elastically expands with expansion of the gas when released from the chamber. The bladder of course may be of any shape or configuration.

Preferably a strap or lanyard is secured to the gas container assembly. The strap or lanyard may be secured to the gas container assembly by the hose-type clamp as referred to above. The strap or lanyard suitably extends into one end of the casing for connection to the gas container. Preferably the casing includes one or more slots suitably in the respective casing parts through which the strap or lanyard passes. The strap or lanyard may be worn around the neck or as a belt around the waist of a user. The strap or lanyard may be an elastic strap or lanyard so as to absorb shock upon inflation of the bladder. The one part of the casing may additionally be formed or moulded with a slot or slit for receipt of a belt therethrough to enable the aid to be worn on the belt around the waist.

In another aspect, the inflation unit is used in association with a pair of pants or other article of clothing, the pair of pants or other article of clothing having a pocket for receipt of the inflation unit of the flotation aid and means are provided to releasably attach the inflation unit of the flotation aid to the pants or article of clothing. Preferably the pocket is located internally of the article of clothing, in the case of pants adjacent a waist band thereof and the pocket opens externally of the pants to receive the inflation unit with the actuator thereof adjacent the waist band. Preferably the attaching means comprises an elongated attaching means such as a strap or strip of material secured to the waist band and the inflation unit. Preferably the strap or strip is releasably attached to the waist band by means of a releasable fastener such as a shackle. The waist band may be provided with a loop of material to which the shackle may be connected.

Preferably the inflation unit is received within a pouch which is located in the pocket. The pouch encompasses and holds the inflation unit prior to actuation thereof. Preferably the pouch includes a top flap to close the pouch and maintain the inflation unit therein. Preferably when the inflation unit is actuated, the top flap is forced open by the inflating bladder to allow release of the bladder from the pouch. Preferably the top flap is normally secured in a closed position by a releasable fastener such as hook and loop or touch and grip material for example of the type known under the trade mark Velcro. Preferably the elongated attaching means extends into the pouch and suitably through an opening or slit in the rear of the pouch for attachment to the inflation unit through the pouch. Thus release of the shackle holding the strap or other elongated securing means to the waist band allows release of the pouch containing the inflation unit from the pocket for replacement purposes.

Preferably a closure flap closes the pocket, the closure flap being openable to provide access to the pouch to allow for actuation of the inflation unit. The closure flap is suitably releasably secured in a closed position closing access to the pocket. The releasable securing means may comprise a releasable fastener such as hook and loop or touch and grip material for example of the type know under the trade mark Velcro When the closure flap of the pocket is opened, the actuating member may be depressed through the pouch to release gas from the gas capsule into the bladder to inflate the bladder with inflation thereof causing it to be forced out of the pouch and the pocket. At the same time the inflation unit with attached bladder will remain connected to the pair of pants or other article of clothing through the elongated attaching means or strap to provide buoyant support to the wearer of the pants.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE PREFERRED EMBODIMENT

Figure 15:
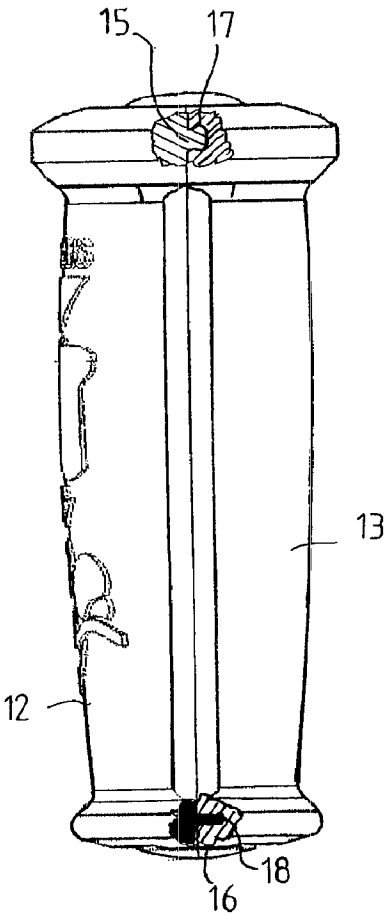
FIG. 15 is a partly cut away side view of the aid.

Referring to the drawings and firstly to FIG. 1 to 10, there is illustrated a personal flotation aid 10 according to an embodiment of the present invention which includes an elongated casing 11 which is longitudinally split into two opposing parts comprising a rigid part 12 and a flexible part 13 and which when engaged with each other define a hollow space therebetween to normally enclose an inflation unit 14 (see FIGS. 10 to 14). The two parts 12 and 13 are adapted to be interconnected as shown in FIG. 15 by lugs or pins 15 and 16 at opposite ends of and on opposite sides of the casing part 12 which are adapted to locate in complementary recesses or slots 17 and 18 at the opposite ends of and on opposite sides of the casing part 13. The connection between the lugs 15 and recess 17 provides a more permanent snap-fit connection between the two casing parts 12 and 13 than the connection between the lugs 16 and recesses 18 for a purpose which will be described further below. This is achieved in the described embodiment by having the lugs 15 as shown of headed or domed form to locate in the complementary recesses 18 which are of re-entrant form.

The flexible casing part 13 additionally includes an integrally formed domed disc-shaped member 19 at the end of the casing 11 adjacent the recesses 17 which defines a push-button for actuation of the aid 10. Additionally each part 12 and 13 is provided at the opposite end of the casing 11 that is the end adjacent the lugs 16 with curved slots 20 and 21 respectively which are adapted to receive respective ends of a looped lanyard or strap 22. (see FIGS. 2 and 11). Opposite mating longitudinally extending edges of the two parts 12 and 13 may be provided with complementary elongated ribs 12' and grooves 13' respectively to locate one part 12 relative to the other part 13 in the assembled position of the two parts 12 and 13.

Figure 13:
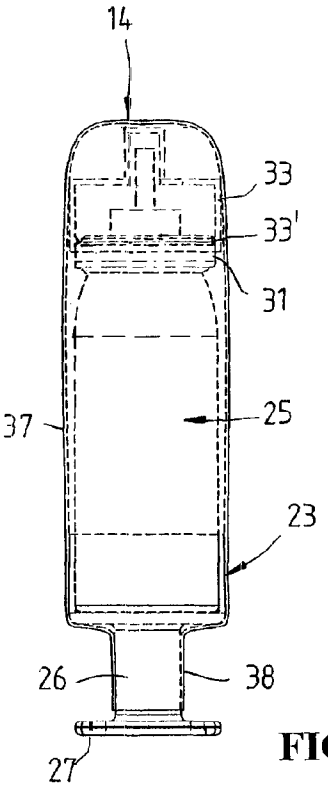
FIG. 13 is a side view of the inflation unit of the aid comprising a bladder and gas canister assembly.
Figure 12A:
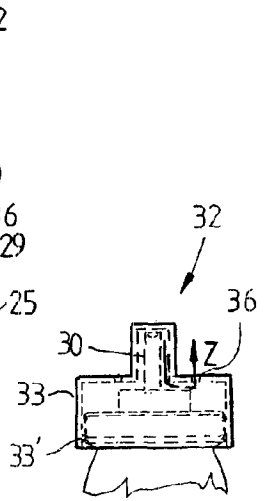
FIG. 12A illustrates the top of the gas canister assembly of FIG. 12 after actuation of the actuator of the gas canister assembly.
Figure 12:
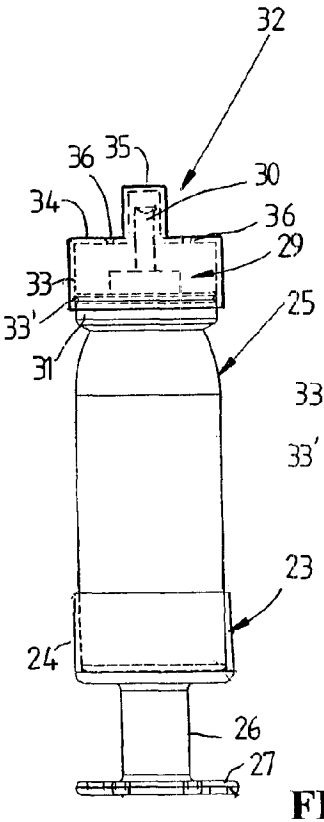
FIG. 12 is a side view of the gas canister assembly of the aid.

The inflation unit 14 as shown in FIGS. 12 and 13 includes a goblet-shaped base member 23 which has a hollow cup-shaped part 24 which is adapted to receive the base of a gas canister 25, the gas canister 25 being frictionally and sealingly engaged within the hollow part 24. The base member 23 additionally includes a rod-like stem 26 and an end flange 27, the end flange 27 being provided with arcuate slots 28 similar to the slots 20 and 21 in the casing parts 12 and 13 and adapted to be aligned therewith. The gas canister 25 is of a know type and includes a spring loaded normally closed valve 29 having a spring-loaded hollow outlet valve actuating tube 30 projecting therefrom which when pressed into the canister 25 allows the release of gas from the canister 25 through the tube 30. The canister 25 additionally includes an annular collar 31 adjacent the valve 29.

An actuator 32 is provided to actuate the valve 29 and allow release of gas from the canister 25. The actuator 32 comprises a hollow cup-shaped member which locates over the annular collar 31, the cup shaped member having a cylindrical side wall 33, an end wall 34 and a hollow actuating member 35 which is in the form of a blind tube projecting centrally from the end wall 35 and coaxially with the side wall 33. The valve tube 30 extends into the hollow actuating member 34. An annular rib 33' is also provided on the inner side wall 33 and is normally located above the collar 31. The end wall 34 of the actuator 32 is provided with one or more apertures 36 therein for passage of gas therethrough. The inner surface of the wall 34 may be in frictional contact with the collar 31 but is slidable axially relative to the collar.

An inflatable balloon-like bladder 37 which is preferably formed of a lightweight impervious material suitably vinyl or plastics is provided for inflation by the gas in the canister 25. The bladder 37 surrounds the gas canister 25 and actuator 32 and has a mouth 38 which is secured to the stem 26 of the base member 23. The valve actuator 32 is thus located within the bladder 35 and the canister 25 is wholly within the bladder 35. The mouth 38 of the bladder 37 is secured by means of a hose-type clamp 39 to the stem 26 to seal the mouth 38 to the stem 26. The mouth 38 of the bladder 37 may also be further sealed to the base member 23 around its periphery by an adhesive. The opposite free ends of the looped lanyard or strap 22 are also secured to the stem 26 by the clamp 39 or an additional clamp, the ends of the lanyard or strap 22 passing when the aid 10 is assembled through the slots 20 and 21 in the casing parts 12 and 13 and the slots 28 in the end flange 29 as is apparent in FIG. 10.

Figure 11:
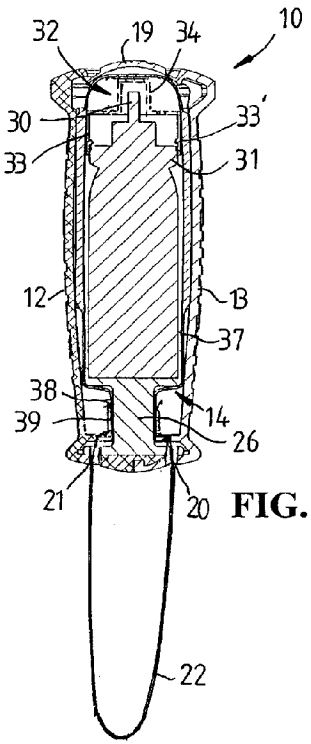
FIG. 11 is a sectional view of the aid along line Y-Y of FIG. 4 with attached lanyard.
Figure 10:
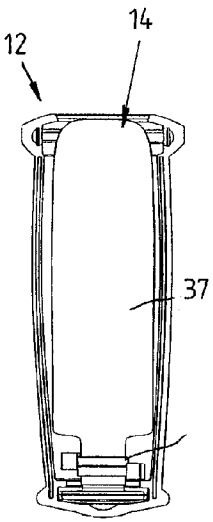
FIGS. 9 and 10 are side views of the respective casing parts of the aid.
Figure 9:
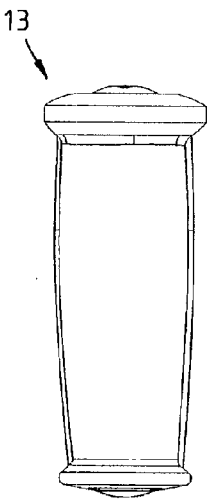
Figure 8:
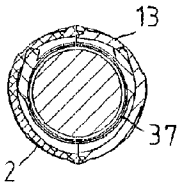
FIG. 8 is a sectional view along line X-X of FIG. 6.
Figure 6:
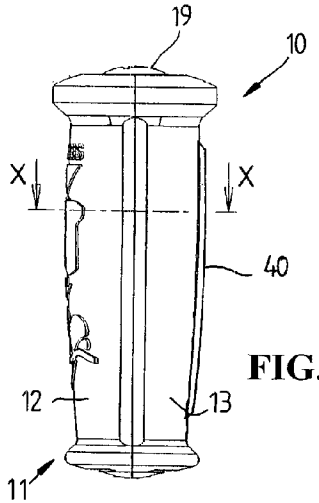
FIG. 6 is a side view of the aid of FIGS. 1 to 3.
Figure 7:
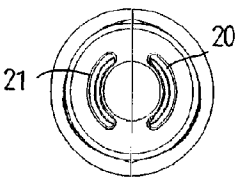
FIG. 7 is a bottom view of the aid of FIG. 6.
Figure 14:
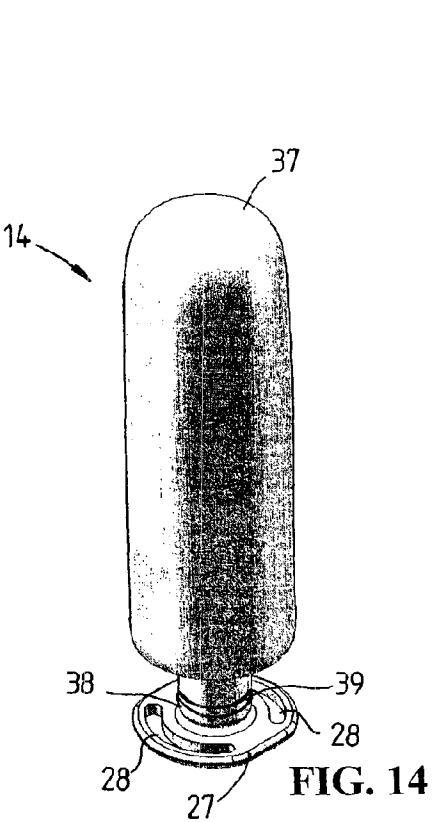
FIG. 14 is a perspective view of the inflation unit.

The bladder 37 is folded about the canister 25 and the assembled inflation unit 14 is located within the casing 11 between the two parts 12 and 13 of the casing 11 which cooperate through the cooperable couplings 15 and 17 and 16 and 18 to retain the inflation unit 14 within the casing 11. In this position, the actuating member 34 is positioned adjacent the push button 19 at the end of the casing 11 as shown in FIG. 11. As the push button 19 is flexible, a force may be applied therethrough and through the bladder 37 to the actuating member 34 to actuate the aid 10 and effect inflation of the bladder 37.

Figure 16:
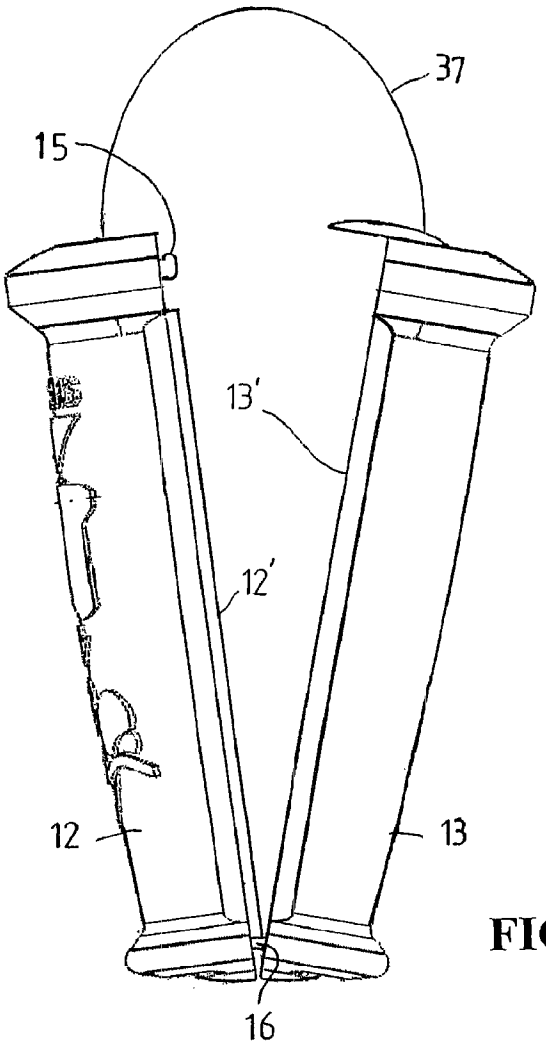
FIG. 16 illustrates the aid of FIG. 15 during actuation.

Thus when it is required to inflate the bladder 37, the actuating member 35 is depressed through the flexible push button 19 which pushes the actuator 32 and wall 33 downwardly causing the annular flange 33' with firm pressure to move downwardly over the collar 31 to locate on the underside of the collar 31 as shown in FIG. 12A to maintain the actuator 32 in an actuated position. Downward movement of the actuating member 34 also causes the valve tube 30 to be urged inwardly of the capsule 25 to open the valve 29. This will cause the release of the compressed gas in a liquid form from the capsule or canister 25 which will pass outwardly through the tube 30 and apertures 36 as indicated by the arrow-headed line Z in FIG. 12A into the bladder 37. As the gas expands, it will rapidly cool and the wall 33 being exposed to the cooling effect of the gas will contract and shrink and further lock onto the flange 31 which will hold the valve tube 30 down and the valve 29 open after actuation. The bladder 37 will thus inflate and as the bladder 37 inflates, the two parts 12 and 13 of the casing 11 will be urged in a hinge like manner away from each other as for example shown in FIG. 16. The expanding bladder 37 alternatively may cause full detachment of the two parts 12 and 13. The bladder 37 will thus be allowed to inflate to its maximum extent determined by the volume of gas contained within the capsule 25 and the inflated bladder 37 can then be used to support a person who may for example be in difficulties whilst swimming.

The lanyard 22 may be as illustrated in the form of an endless loop which can be simply worn around the neck of a user so that the flotation aid 10 is suspended from the neck. Alternatively, the lanyard 22 may be formed of an elastic or resilient material such that it may be worn around the waist in the nature of a belt. In this case and when the aid 10 is actuated, the bladder 37 will be inflated at the front or side of the user who may with one or both hands hold the inflated bladder 37 against the body so as to receive buoyant support until rescued or he or she is able to make their own way to safety. The two parts of the lanyard or strap 22 may be joined together such as by sewing so that when worn around the waist, the aid 10 will hang downwardly. The aid 10 may also be positioned underneath the shorts or swimsuit of the wearer.

Figure 5:
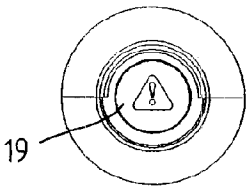
FIG. 5 is a top view of the aid of FIG. 4.
Figure 4:
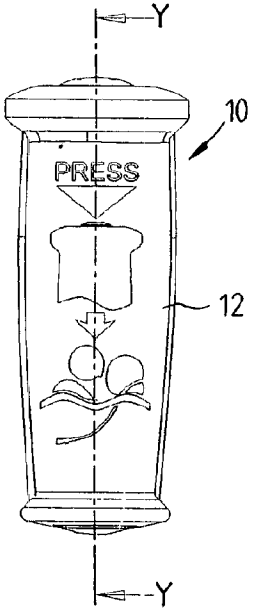
FIG. 4 is a front view of the aid of FIGS. 1 to 3.
Figure 3:
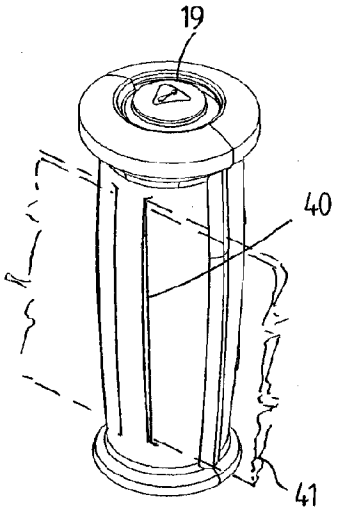
FIGS. 1 to 3 are different perspective views of a personal flotation aid according to an embodiment of the present invention.
Figure 1:
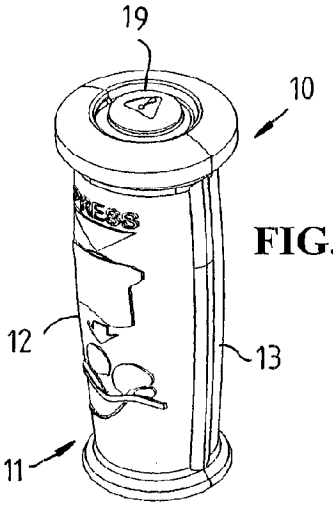
Figure 2:
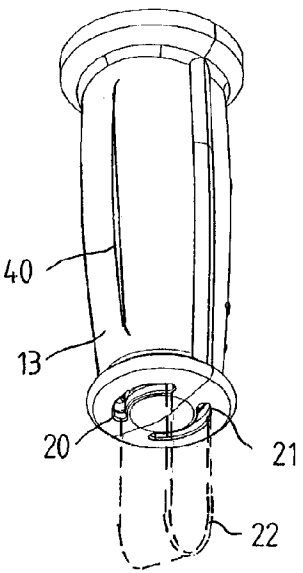

The aid 10 may also for convenience worn on the belt of a person and for this purpose the flexible casing part 12 may be moulded with an elongated slit 40 on one side (see FIGS. 2 and 3) through which a belt 41 may be passed as shown in dotted outline in FIG. 3. Alternatively, the aid 10 may simply hang from a belt which is passed through the lanyard or strap 22.

The bladder 37 whilst being described to be of a balloon shape may be of any other shape or configuration. The gas stored in the capsule is preferably R143 propellant gas or alternatively other gases may be employed.

Of course, the aid 10 may be simply hand carried for use in other situations for example where sailing or boating or attached to another part of the body. In this case, a quick release fastener may be provided to normally hold the bladder in position but which when released will allow rapid bladder inflation.

The casing 11 as illustrated in the embodiments is shown to be of a generally tubular configuration however it may be of any shape or configuration. It is preferred however that at least one part 13 of the casing 11 be formed of a flexible material so as to facilitate rapid separation of the casing parts 11 and 12 as in FIG. 16 and further for easy gripping. Both parts 11 and 12 however may be formed of a rigid or relatively rigid material.

Figure 17:
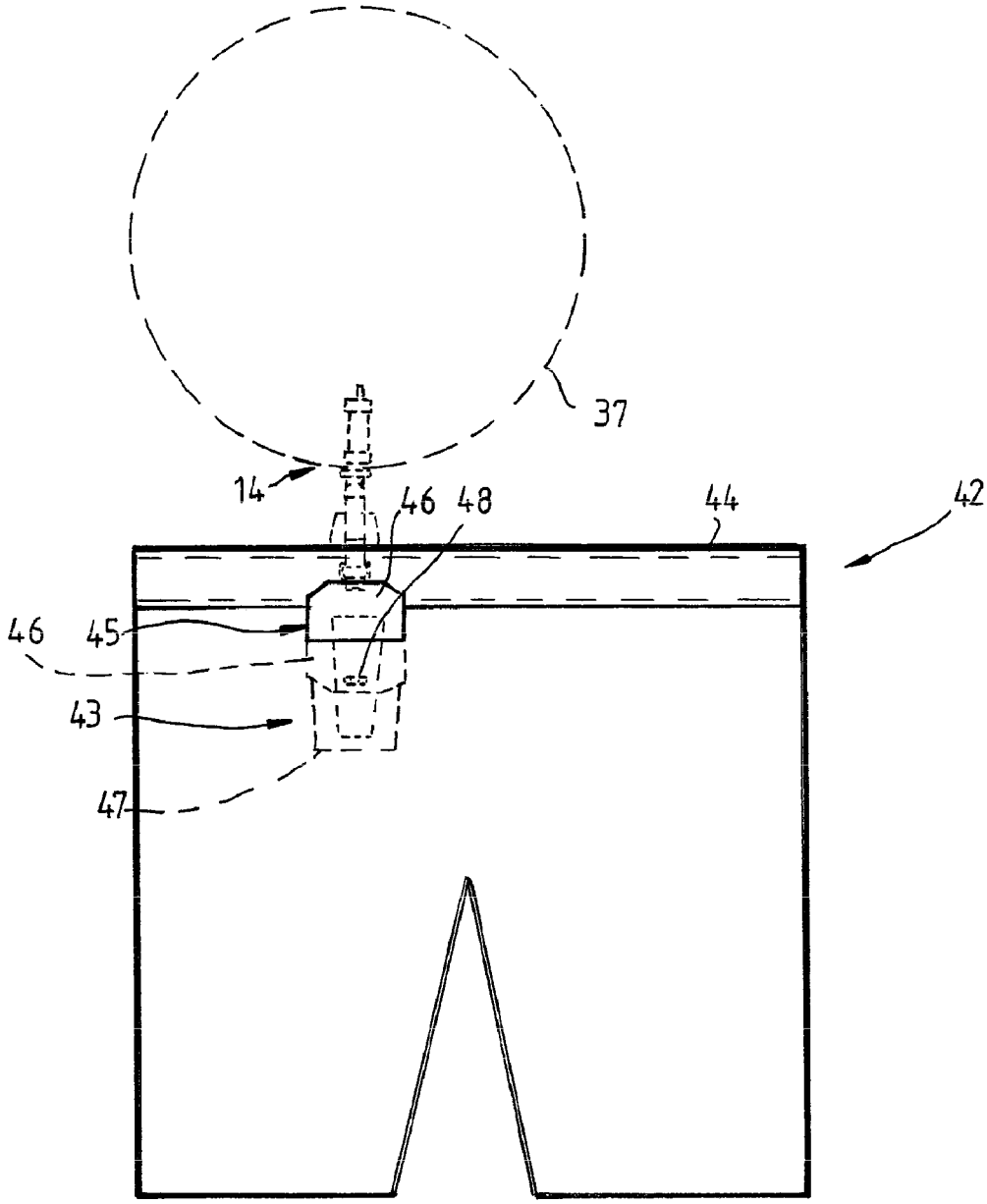
FIG. 17 illustrates an article of clothing in the form of pair of shorts incorporating the inflation unit of the invention.
Figure 18:
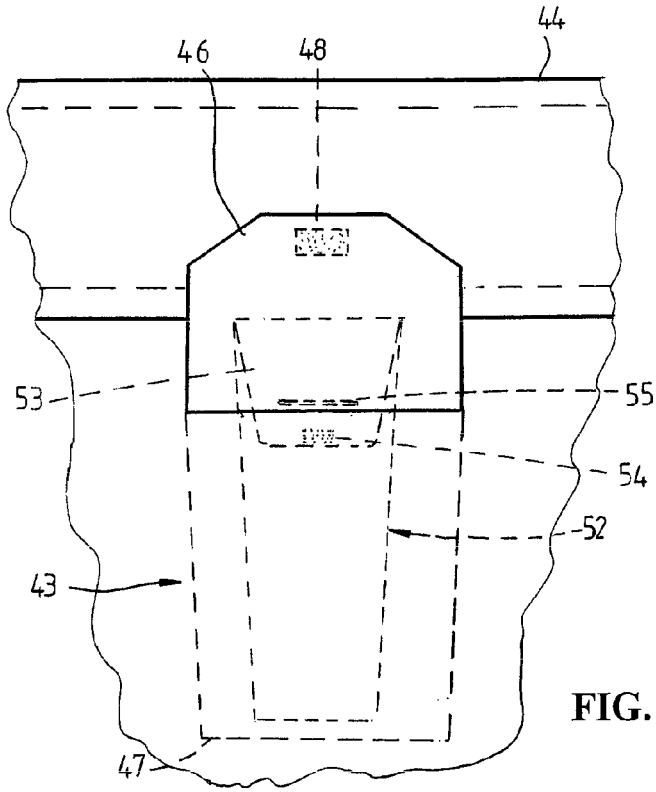
FIG. 18 illustrates in enlarged elevational view, a pocket attached to the shorts containing the inflation unit located within a holding pouch.
Figure 19:
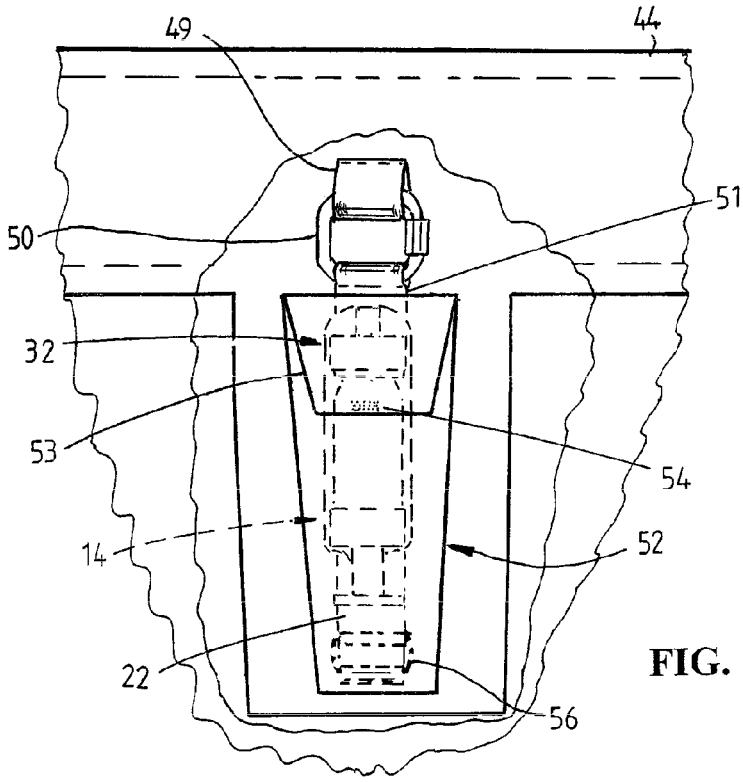
FIG. 19 illustrates in enlarged cut-away view the pocket containing the holding pouch and inflation unit.

FIGS. 17 to 19 illustrates the incorporation of the inflation unit 14 of the aid 10 in an article of clothing comprising in this embodiment a pair of swim or board shorts 42 or other pants or shorts such as wet suit shorts. The shorts 42 are provided with an elongated pocket 43 which as shown in FIG. 18 is secured such as by sewing to the inside of the upper waist band 44 of the shorts 42 but opening as at 45 to the exterior of the shorts below the waist band 44. A closing flap 46 of fabric is provided on the outside of the shorts 42 to lie over and close the opening 45 into the pocket 43 whilst the pocket 43 is closed at its lower end 47 on the inside of the shorts 42. The flap 46 is secured in a closed but releasable position by cooperative hook and loop material 48 or by any other releasable fasteners on the pocket 43 and flap 45.

A loop 49 of strip fabric material is located beneath the closed flap 45 and secured to the waist band 44 such as by sewing. A releasable shackle 50 is passed through the loop 49 to secure the loop 49 to an elongated strip 51 of elastic material. The inflation unit 14 is held within a separate pouch 52 formed of a fabric material which holds the bladder 37 of the inflation unit 14 neatly in position with the inflation unit 14 in an upright position with the actuator 32 uppermost. The pouch 52 is closed by a flap 53 held normally in a closed position by hook and loop material 54 or the like The pouch 52 is provided with a slit or slot 55 on its rear side (see FIGS. 18 and 20) and the strip 51 passes from its connection to the shackle 50 through the slit 55 to be connected at its free end through a ring 56 to an end of the inflation unit 14 via a lanyard 22' similar to the lanyard 22 of FIG. 10 but of reduced length. The actuator 32 of the inflation unit 14 may be actuated through the flap 53 of the pouch 52 when the pocket flap 46 is opened or the flap 53 may be lifted to depress the actuator 32.

Figure 20:
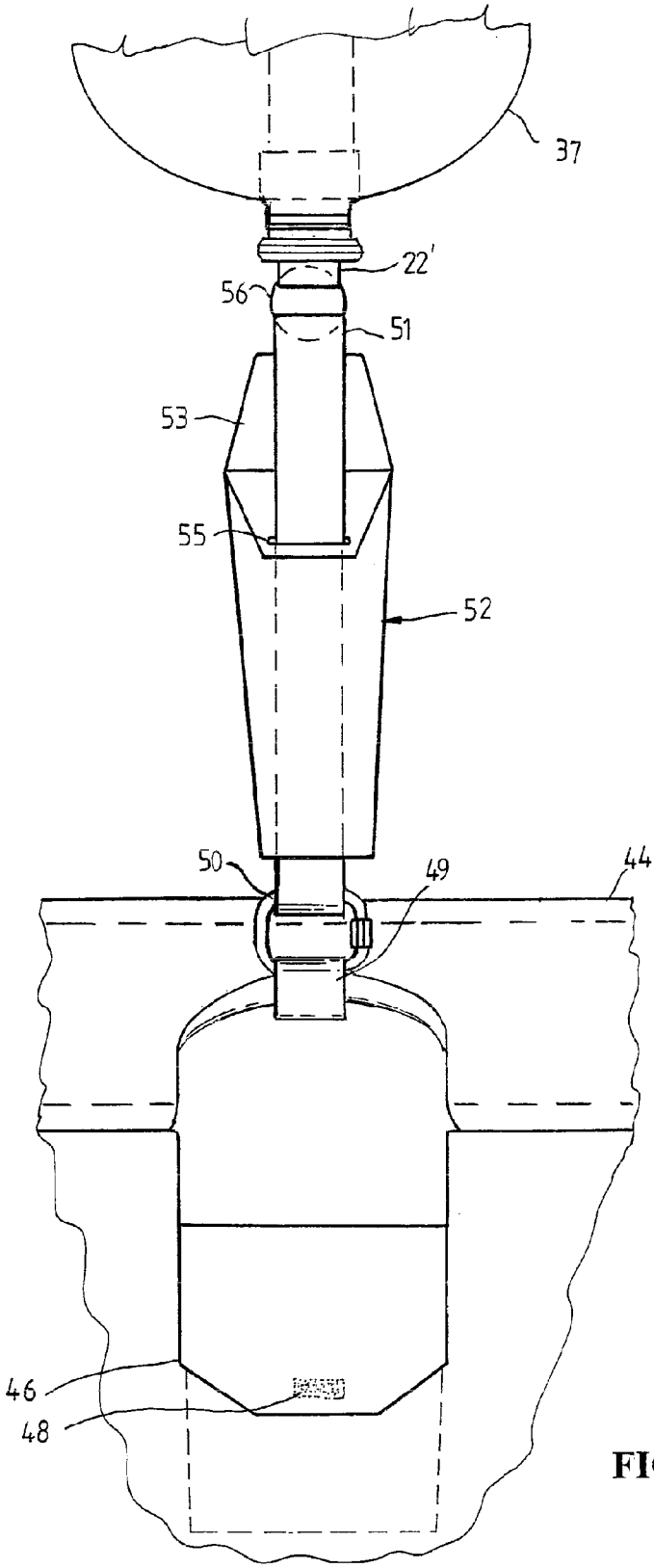
FIG. 20 illustrates the inflation unit, the inflating bladder and pouch attached to the shorts after actuation of the inflation unit.

In use, the shorts 42 carrying the inflation unit 14 within the pouch 52 and pocket 43 and are worn in the usual manner however if the wearer requires buoyant support whilst swimming or surfing, the flap 46 can be released by detaching the hook and loop material 48 and the actuator 32 of the inflation unit 14 within the bladder 37 can then be depressed through the pouch flap 53. This will allow the release of gas from the capsule 25 into the bladder 37 as described above. As the bladder 37 inflates, the expansion thereof will cause the flap 53 of the pouch 52 to be forced open and the inflation unit 14 to be forced out of the pouch 52 with the buoyancy of the inflating bladder 37 causing it to move upwardly in the water in which the bladder 37 is inflating. The bladder 37 will fully inflate at the front of the wearer of the shorts 42 as shown in dotted outline in FIG. 17 to provide buoyant support to the wearer. The strip 51 of elastic material however will maintain the bladder 37 tethered to the shorts 42 through the shackle 50 and loop of material 49 as shown in FIG. 20. The elasticity of the strip 51 will provide a degree of resilience between the bladder 37 and shorts 42.

After use, the expended inflation unit 14 can be detached from the shorts 42 via the shackle 50 and reused by replacement or refilling of the capsule 25 and the shorts 42 may be used without an inflation unit 14 attached.

Whilst the inflation unit 14 is described in association with an article of clothing in the form of pants, it may be used in connection with other articles of clothing being located in a pocket of the clothing and being attached to the article of clothing by a strap or strip of material in a similar manner to that described above. For example the article of clothing may comprise a shirt such as a wet shirt or swimming shirt or simply a casual shirt having a pocket in which the inflation unit 14 is located preferably in the described pouch with a strip or strap of material being attached to the inflation unit 14 and to the shirt through a shackle/loop connection as described or by a more permanent connection.

The terms "comprising" or "comprises" as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as defined in the appended claims.

The invention claimed is:

1. A flotation aid comprising an inflation unit having:

an inflatable bladder;

a gas container assembly including a gas container comprising a gas capsule or canister containing a compressed gas for inflating said bladder, said gas container including valve means at one end through which a gas may be released into said bladder, said gas capsule or canister including an annular collar adjacent the valve means, said gas container assembly being located at least substantially within said bladder, said gas container assembly further including an actuator adjacent said one end of said gas container, said actuator being actuable externally of said bladder and being movable longitudinally of said container and slidable over said collar when actuated to cause said valve means to move to an open position, said actuator cooperating with said gas container when actuated to maintain said valve means in said open position to allow release of gas from said gas container into said bladder to inflate said bladder.

2. A flotation aid as claimed in claim 1 wherein a gas capsule holder is provided at the other end of the gas capsule or canister, and wherein the bladder has a mouth which is sealed to said holder.

3. A flotation aid as claimed in claim 2 wherein the capsule holder includes a hollow cup-shaped portion in which the capsule or canister seats and a stem and wherein the mouth of the bladder is sealed to the stem.

4. A flotation aid as claimed in claim 1 wherein said actuator includes a stop member adapted to locate on a lower side of the collar when the actuator is actuated to maintain said actuator in an actuated position.

5. A flotation aid as claimed in claim 4 wherein the actuator includes a body having a wall which surrounds and is frictionally engaged with the collar and wherein said stop member is provided on the inside of said wall and is forced from a position on the upper side of the collar to a position on the lower side of said collar when said actuator is actuated.

6. A flotation aid as claimed in claim 1 wherein the actuator includes an actuating member which when depressed causes the valve means to open, said valve means comprising a valve member which extends from the gas capsule and wherein depression of the actuating member causes movement of the valve member and opening of the valve means.

7. A flotation aid as claimed in claim 6 wherein the actuator body and/or actuating member is/are provided with one or more apertures to allow release of gas passing through the open valve means into the bladder.

8. A flotation aid comprising an inflation unit having:

an inflatable bladder;

a gas container assembly including a gas container containing a compressed gas for inflating said bladder, said gas container including valve means at one end through which a gas may be released into said bladder, said valve means including a hollow valve actuating tube extending longitudinally of said gas container through which gas passes upon actuation of said valve means, said gas container including an annular collar adjacent said valve means, said bladder being sealed to said gas container assembly and at least said one end of said gas container assembly being located within said bladder, said gas container assembly further including actuator means adjacent said one end of said container, said actuator means having a main hollow body which extends over said collar of said gas container and an actuating member aligned with said valve actuating tube, said main hollow body and/or actuator member having one or more apertures therein for escape of gas therethrough, said actuator member being actuable externally of said bladder and being movable longitudinally of said container to an actuated position to depress said valve actuating tube and cause said valve means to move to an open position, and means for maintaining said actuator member when actuated in said actuated position in which said valve means is in said open position to allow release of gas from said gas container into said bladder through said one or more apertures in said main hollow body to inflate said bladder.

9. A flotation aid as claimed in claim 8 wherein said inflation unit is located within an external casing and is adapted to be actuated externally of the casing.

10. A flotation aid as claimed in claim 9 wherein said casing comprises a two-part longitudinally split casing, said parts of the casing being interconnected but being adapted to be at least partially separated upon and by inflation of the bladder.

11. A flotation aid as claimed in claim 10 wherein one of the casing parts includes a flexible portion which allows for actuation of the actuating means.

12. A flotation aid as claimed in claim 11 wherein said one casing part is formed of a flexible material and defines a push button at one end of the casing aligned with the actuating member.

13. A flotation aid as claimed in claim 12 and including a strap or lanyard secured to the gas container assembly, said strap or lanyard extending into one end of the casing for connection to the gas container.

14. A flotation aid as claimed in claim 8 and associated with an article of clothing, said article of clothing having a pocket for receipt of said inflation unit and means releasably attaching the inflation unit to said article of clothing.

15. A flotation aid as claimed in claim 14 wherein said article of clothing comprise pants and wherein said pocket is located internally of said pants adjacent a waist band thereof and opens externally of said pants to receive said inflation unit with said actuating means located adjacent said waist band and wherein said releasable attaching means including a strap or strip of material attached to said pants and said aid.

16. A flotation aid as claimed in claim 14 wherein said aid is located within a pouch located within said pocket and wherein said strap or strip of material is attached to the inflation unit of the aid through said pouch.

17. A flotation aid as claimed in claim 16 and including a closure flap which normally closes the pocket, said closure flap being openable to provide access to the pouch for actuation of said inflation unit through said pouch.

18. A floatation aid as claimed in claim 8 wherein the gas container comprises a gas capsule or canister, said capsule or canister including an annular collar adjacent the valve means and wherein said hollow main body of said actuator means has a side wall or skirt adapted to extend over said collar.

19. A flotation aid as claimed in claim 18 wherein said main hollow body of said actuator means includes an annular stop member on said side wall or skirt adapted to cooperate with said collar to maintain said body of said actuator means engaged with said collar.

20. A flotation aid comprising an inflation unit having:

an inflatable bladder;

a gas container assembly including a gas container comprises a gas capsule or canister containing a compressed gas for inflating said bladder, said gas container including valve means at one end through which a gas may be released into said bladder, said valve means including a hollow valve actuating tube extending longitudinally of said gas container through which gas passes upon actuation of said valve means, said gas capsule or canister including an annular collar adjacent the valve means, said bladder having a mouth sealed to said gas container assembly and at least said one end of said gas container being located within said bladder, said gas container assembly further including actuator means adjacent said one end of said gas container, said actuator means including a main hollow body having a side wall or skirt which extends over said annular collar and is frictionally engageable therewith and an actuating member aligned with said valve actuating tube, said actuating member being actuable externally of said bladder and being movable longitudinally of said container to an actuated position to depress said valve actuating tube and cause said valve means to move to an open position, and means for maintaining said actuator member when actuated in said actuated attitude to allow release of gas from said gas container into said bladder to inflate said bladder.

* * * * *